United States Patent [19]

Durland et al.

[11] 3,958,753

[45] May 25, 1976

[54] AIR DRIVEN CENTRIFUGE

[75] Inventors: Douglas H. Durland, Palo Alto; Charles H. Chervenka, Sunnyvale; Malcolm C. McGilvray, Jr., Palo Alto, all of Calif.

[73] Assignee: Beckman Instruments, Inc., Fullerton, Calif.

[22] Filed: Apr. 11, 1975

[21] Appl. No.: 567,255

[52] U.S. Cl. ..... 233/23 R; 233/23 A; 233/1 C; 192/144; 188/180

[51] Int. Cl.[2] ..... B04B 9/06; B04B 9/14

[58] Field of Search ..... 233/23 R, 23 A, 24, 233/26, 1 R, 1 C; 192/144; 188/180

[56] References Cited

UNITED STATES PATENTS

| | | | |
|---|---|---|---|
| 2,213,107 | 8/1940 | McBain | 233/23 R |
| 2,377,175 | 5/1945 | Peer | 233/23 R |
| 2,872,104 | 2/1959 | Cizinsky | 233/23 R |
| 3,322,338 | 5/1967 | Stallman et al. | 233/23 R |
| 3,430,852 | 3/1969 | Lenkey et al. | 233/23 R |
| 3,456,875 | 7/1969 | Hein | 233/24 |

FOREIGN PATENTS OR APPLICATIONS

| | | | |
|---|---|---|---|
| 783,685 | 9/1957 | United Kingdom | 233/23 R |
| 839,622 | 6/1960 | United Kingdom | 233/23 R |

*Primary Examiner*—George H. Krizmanich
*Attorney, Agent, or Firm*—R. J. Steinmeyer; F. L. Mehlhoff

[57] ABSTRACT

An air driven centrifuge including a rotor chamber having a rotor seat mounted in the bottom thereof and including a rotor having a plurality of turbine flutes formed in an under side thereof. The rotor seat includes driving air jet means for impinging pressurized air streams against the turbine flutes of the rotor for supporting and spinning the rotor on an air cushion above the rotor seat. Support air jet means are also provided in the seat for directing pressurized air streams against the under side of the rotor for supporting the rotor when the driving air jet streams are inactivated. A brake and stabilizing means is included for decelerating the spinning rotor and includes a friction bearing means on the bottom portion of the rotor and a stabilizer means movable into engagement with the bearing means and cooperating with the bearing means to produce a frictional load against the bearing means thereby causing the rotor to decelerate and also stabilizing the rotor as it slows to a stop.

21 Claims, 7 Drawing Figures

AIR DRIVEN CENTRIFUGE

BACKGROUND OF THE INVENTION

The invention described herein relates generally to an air driven centrifuge and more particularly to an improved apparatus for decelerating an air driven centrifuge rotor and for stabilizing such rotor as its speed reduces.

In order to separate certain fluid mixtures, very high speeds of rotation are often required. For example, separation of proteins, viruses and various clinical specimens require extremely high speeds of centrifugation in order to separate fractions thereof within reasonable time spans. It has been found that extremely high rotational speeds (such as 150,000 R.P.M. to 200,000 R.P.M.) can be attained by rotating a centrifuge rotor on a cushion of air with pressurized air streams. An example of such an air driven centrifuge is illustrated in U.S. Pat. No. 3,456,875 issued to George N. Hein on July 22, 1969.

Because air driven centrifuge rotors are supported on a substantially friction-free cushion of air it is difficult to design an air delivery system that will make the rotor come to a gradual, complete stop. While great pains in design can be taken to hold any rotational effect due to the stopping air stream to a minimum, it is impossible to completely eliminate any rotational effect. There is always a certain amount of "windmilling" by the supporting or holding air stream across the turbine flutes of such a rotor.

In addition, the design of a rotor, or the loading of the sample therein, always introduces certain parameters which create critical speeds at which the rotor will precess, wobble or vibrate excessively while decelerating. These critical speeds are usually relatively low rotational speeds and the precession and/or wobbling can become so great as to cause the sample to be remixed or to cause the rotor to come into contact with the sidewalls of its seat thereby causing it to jump from its rotational axis and thrash around within the centrifuge chamber. The present invention overcomes these problems.

SUMMARY OF THE INVENTION

In accordance with the invention, there is provided an air driven centrifuge including a rotor chamber housing a rotor seat and a rotor having a plurality of turbine flutes formed in an under side thereof, the rotor seat having formed therein a driving air jet means for impinging pressurized air streams against said turbine flutes for driving the rotor and supporting the rotor on an air cushion above the rotor seat; the seat also includes supporting air jet means for directing pressurized air streams against an under side of said rotor for supporting the rotor in a non-driving position above the rotor seat when the driving air jet means is inactivated, the centrifuge also including brake and stabilizing means in the form of a friction bearing means mounted on the bottom portion of the rotor and a brake member movable into engagement with the bearing means and cooperating with the bearing means to produce a frictional load against the bearing means and the rotor thereby causing the rotor to decelerate and also stabilizing the rotor as it reduces from high rotational speed to a stop.

It is an object of this invention to provide an air driven centrifuge including means for adding a small amount of mechanical support to the rotor at low rotational speeds to provide stabilization thereof.

It is also an object of the present invention to provide an improved air driven centrifuge having an improved braking system for decelerating the rotor.

It is another object of the invention to provide an air driven centrifuge apparatus including an improved arrangement for adding a small frictional load causing the rotor to decelerate gradually and to support the rotor as it passes through critical speeds of rotation during such deceleration.

Further objects and advantages of the invention will become apparent as the following description proceeds, and the features of novelty which characterize the invention will be pointed out with particularity in the claims annexed to and forming a part of this specification.

DESCRIPTION OF THE PREFERRED EMBODIMENTS

Figure 1:
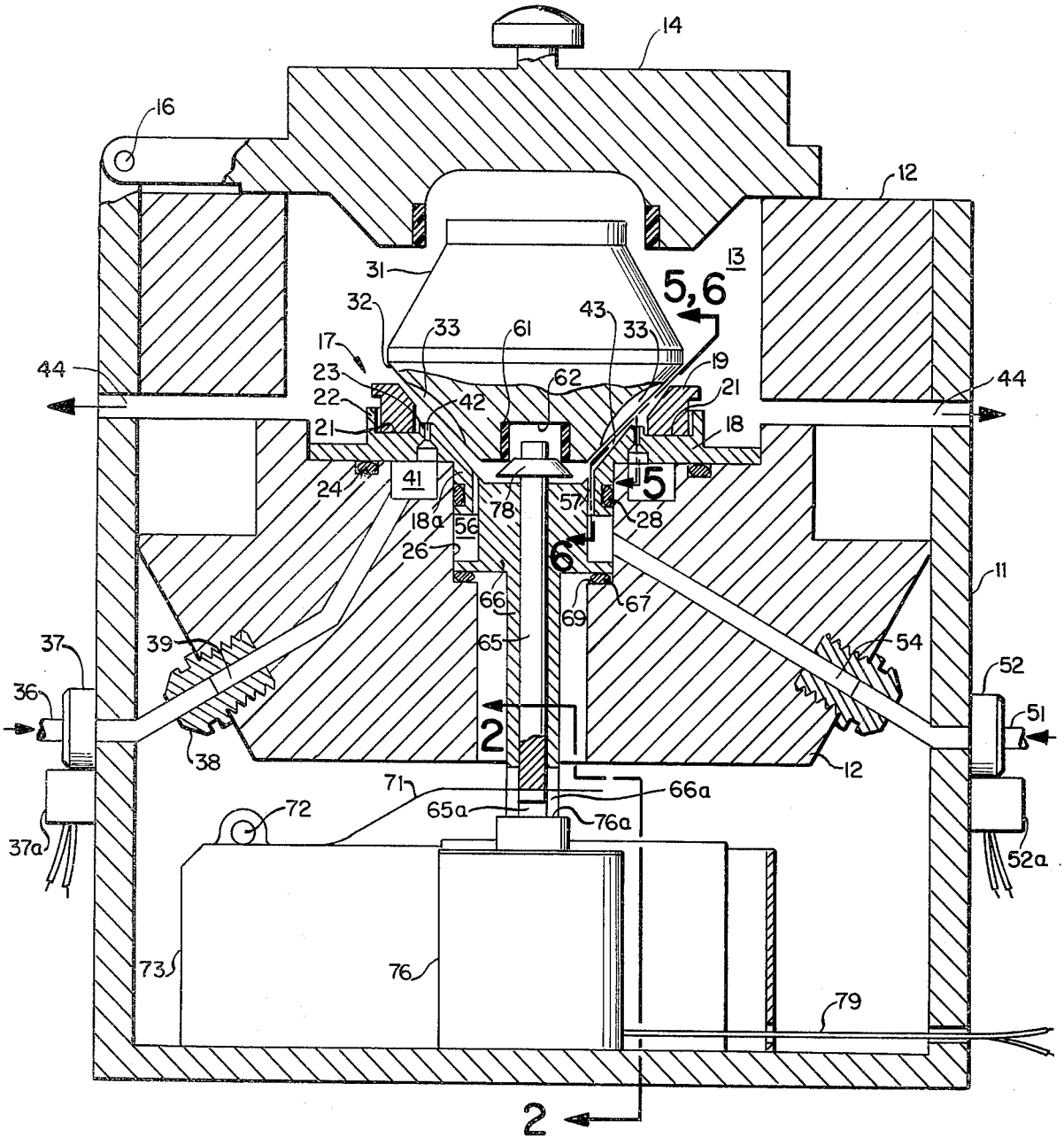
FIG. 1 is a cross-sectional elevation view of an air driven centrifuge with arrows showing the direction and path of flow of the air streams for driving and supporting the rotor.

Referring now to FIG. 1 of the drawings, there is shown a centrifuge apparatus employing a preferred embodiment of the invention. The apparatus includes an outer casing 11 which supports a housing 12 in which is formed a generally cylindrically shaped rotor chamber 13. Attached to the housing for closing the upper or open end of the rotor chamber 13, is a cover member 14, hinged at 16 to the case 11 so that it may be pivoted upwardly and out of the way of the open end of the rotor chamber 13. Disposed in the lower portion of the rotor chamber 13 on the surface of the housing 12, is a rotor seat, generally designated by reference numeral 17. The rotor seat 17 includes a stator pad base 18, attached to the floor of the housing 12, and including a depending cylindrically shaped extension 18a positioned in an opening or bore 26 formed through the lower portion of the housing 12. A stator pad 19 is positioned on the stator pad surface and is movable or "free floating" between annular flanges 22 and 23. Beneath the stator 18 is an O-ring seal 24 which seals the lower surface of the stator 18. The depending section 18a is also provided with a groove and an O-ring 28, forming a seal between the depending cylindrical extension and the housing 12.

Mounted within the rotor chamber 13 on the rotor seat 17 is a rotor 31 having an underside slanting upwardly in the outward direction. That is the under sidewall 32 of the rotor 31 is essentially conically shaped and is provided with a plurality of turbine flutes or vanes 33 (better seen in FIGS. 5 and 6). Turbine flutes 33 are formed at intervals entirely around the under surface 32 of the rotor and serve to facilitate the driving of the rotor 31 by compressed air. Within the rotor is a cavity or a plurality of tube cavities (not shown) adapted to receive liquid samples for centrifugation. Normally the samples are inserted into test tubes having the shape of the cavities of the rotor. These cavities are normally arranged at an oblique angle with their openings inwardly toward the upper portion of the rotor so that, on centrifugation, liquids within such cavities are formed into bands of centrifuged fractions.

The conically shaped sidewall 32 of the rotor is designed to seat on the stator pad 19 as indicated in FIG. 1. The slant of the sidewall 32 is slightly less than the slant of the rotor seat comprising the inner wall of the stator pad 19 and the inner wall portion of the stator pad base 18. When the rotor 31 is not in motion or during slow speeds of rotation, the rotor rests on the stator pad 19, as described in the aforementioned U.S. Pat. No. 3,456,875 issued to G. N. Hein.

Figure 5:
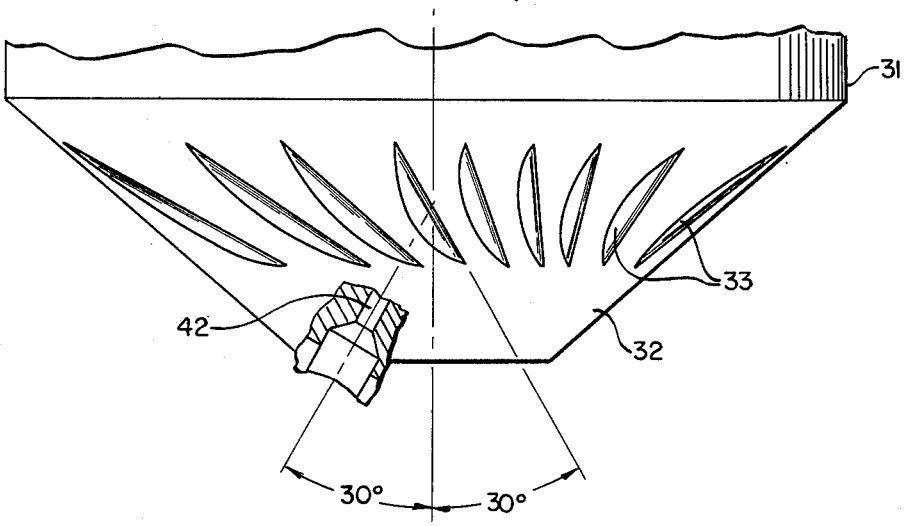
FIG. 5 is a fragmentary elevation view, taken substantially along line 5—5 of FIG. 1, illustrating in partial cross-section a driving jet nozzle for directing a stream of air toward the rotor flutes.
Figure 6:
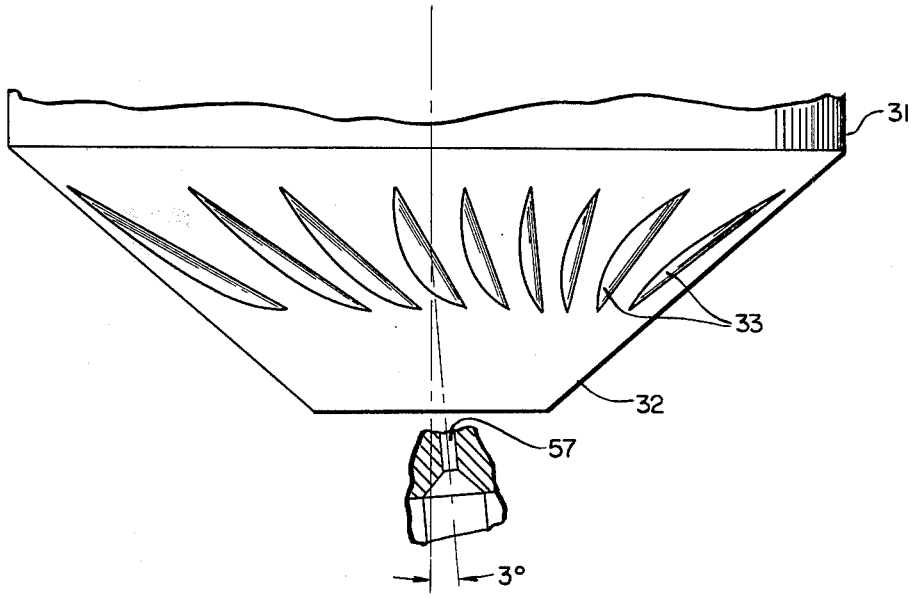
FIG. 6 is a fragmentary elevation view taken substantially along line 6—6 of FIG. 1 and illustrating the cooperation between the rotor and the supporting air jet nozzles.

A pressurized driving air stream is conducted into the housing by means of a tube 36 and valve means 37. A delivery tube, through a suitable connector 18, delivers pressurized air to the housing member 12 whereupon it flows through a passage 39 into an annular manifold 41. From the annular manifold 41 the pressurized air is directed upwardly through a plurality of driving air jet nozzles 42, positioned at spaced intervals around the stator base 18. The annular manifold 41 is, as can be seen in FIG. 1, sealed by means of the O-rings 24 and 28. The introduction of driving air through the nozzle 42 is best illustrated in FIG. 5, which shows the nozzle 42 directed at an angle of approximately 60° to the driving flutes 33. Nozzles 42 direct the pressurized air streams against the flutes 33 to rotate and support the rotor. While the angle illustrated in FIG. 1 is approximately 60°, it should be understood that any suitable angle may be employed depending upon the shape of the flutes 33. In a tested embodiment, the nozzles 42 were arranged at 90° to the central flat surface of the flutes and this produced extremely high rotative speeds.

As the pressurized air streams are injected against the rotor and the turbine flutes or vanes 33, the rotor 31 commences to spin. It is then supported at high speeds on a cushion of air between the rotor 31 and the seat 17. The rotor does not touch the stator base or the stator pad 19, as illustrated in FIG. 1, by the air space 43. Air space 43 also acts as an exit passage for the compressed air after it has contacted, rotated, and supported the rotor. The air then enters the rotor chamber 13 and exits from the chamber through a plurality of openings 44 formed through the housing 12 and the casing 11.

In order to stop the rotor and to support the rotor while it is decelerating, there is provided a second pressurized or levitation air stream introduced into the apparatus through tubing 51, the valve 52 and connecting to the rotor chamber housing 12 by means of the fitting 53. A passage 54 in the housing 12 directs the support air stream into an annular manifold 56, whereupon it is directed into a plurality of supporting air jet nozzles 57 directed at the under or lower surface of the rotor 31. The levitation air stream may be continuously passed through the openings 57 even while the driving air stream is actuated. However, if the levitation air stream is not continuously applied, it should be actuated just prior to inactivation of the driving air stream or simultaneous with the inactivation of the driving air stream in order to make certain that the rotor 31 does not fall onto its seat. In this way, the rotor is continuously supported by an air cushion between the rotor and the rotor seat 17. As may best be seen in FIG. 6, the rotor or the support air nozzles 57 are arranged almost parallel to a plane passing through the axis of the rotor seat. In practice, it has been found desirable to design the jet nozzles 57 so that they actually direct air in a direction opposed to the rotation of the rotor at an angle of 5° or less. This tends to retard the rotational motion of the rotor 31 and causes it to decelerate.

Valve means 27 and 52 are provided to control the air pressure and may be operated manually or by electromechanical means, such as solenoid valves **37*a* and 52*a*. Valves 37*a* and 52*a* may be electrically adjusted so that when valve 37*a* is deactivated valve 32*a* is immediately activated or, preferably, activated just prior to deactivation of valve 32*a*. While, in the illustrated embodiment, the support air stream flows through jet nozzles 57, this support air stream can also be introduced as a sheath of support air flowing between the guide bushing 66 and the depending portion 18*a* of the stator base 18. While great pains may be taken to hold any rotational effect of the support air stream to a minimum, it is impossible to completely eliminate the effect of the support air stream flowing through the turbine flutes 33**. There is a tendency for the support air to continue to rotate the rotor, an effect referred to as "windmilling." In order to assure that the rotor stops and does not either reverse its rotation or continue to rotate as a result of the support air streams, the present invention includes a braking and stabilizing means adapted to gradually bring it to a complete stop.

This is shown in FIG. 1 and comprises, in the preferred embodiment, a friction bearing means or bushing 61 mounted within an opening or hole 62 formed in the bottom portion of the rotor 31. Bushing 61 is preferably formed of a "TEFLON" or other plastic, relatively soft and smooth material. Positioned axially for movement in a direction upwardly into contact with the friction bearing means on the rotor is a brake and stabilizing means comprising an actuating pin member 65 and a brake member 78. Pin member 65 is positioned within a sleeve or guide 66, centrally disposed within the cavity or bore 26 formed through the lower portion of the rotor housing 12. The sleeve 66 actually cooperates with the bore 26 to form the manifold 56 into which levitation air is directed and cooperates with the lower section **18*a* of the stator pad to form the jet nozzles 57. The sleeve 66 rests on an O-ring 67 positioned against a lower shoulder 69 of the cavity 26. This forms a seal against the escape of air through the lower portion of the bore 26**.

As will best be seen in FIG. 1, the brake and stabilizing means also includes a biasing force which, in this preferred embodiment, is in the form of spring member 71 adapted to abut against a lower portion of the pin 65. In this embodiment of the invention, the spring 71 is a long spring member 71 passing through a notch 65*a*, formed at the bottom of the pin 65. Spring member 71 is coiled around a supporting spring arm 72 which is, in turn, supported on a suitable bracket 73 mounted in the bottom of the casing below the housing 12. Arm 72 is provided with a notch on one end thereof which extends through the outer portion of the casing 11 so that the arm may be rotated to adjust the force of the spring member 71.

Figure 2:
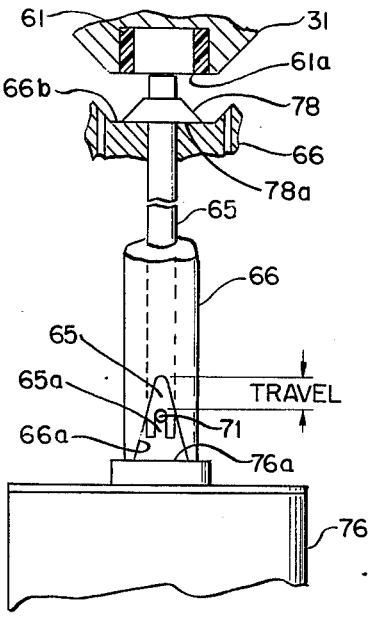
FIG. 2 is a fragmentary view taken substantially along line 2—2 of FIG. 1 and illustrating the braking and stabilizing actuator in its deactivated position.
Figure 3:
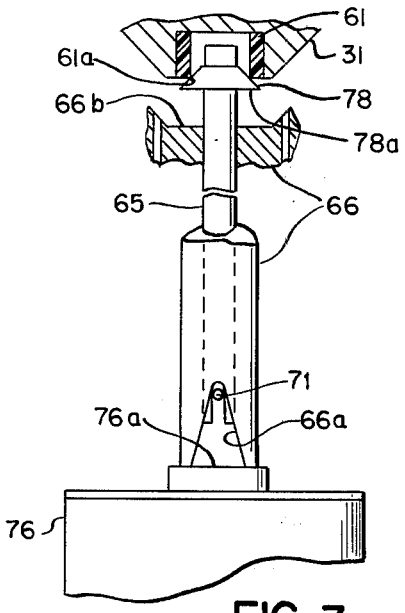
FIG. 3 is a fragmentary view similar to that of FIG. 2 illustrating the position of the brake and stabilizer means in its actuated position.
Figure 4:
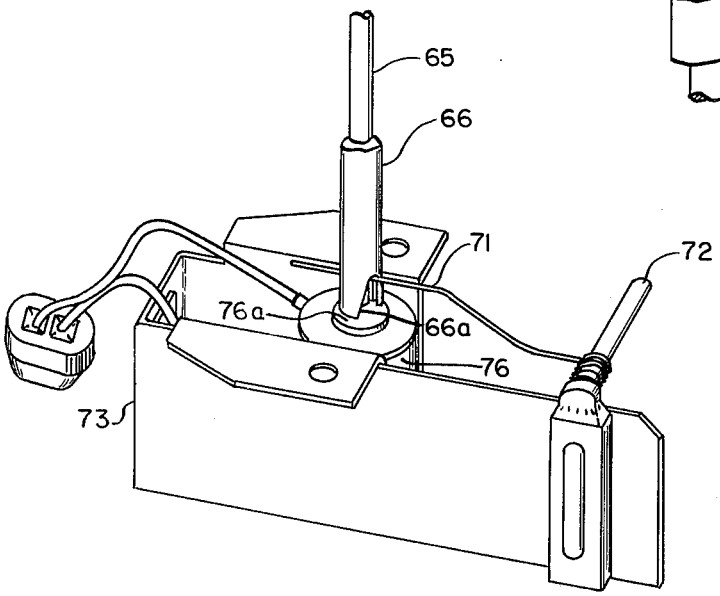
FIG. 4 is a fragmentary isometric view of the brake and stabilizer actuation means and illustrating a spring arrangement for biasing the brake pin in the upward direction toward the rotor.

The operation of the brake and stabilizing means may best be understood by reference to FIGS. 2, 3 and 4. As will be seen in FIG. 4, the lower portion of the sleeve 66 is tubular and extends downwardly to a position where it rests on the surface 76*a* of an electromagnet 76. Power to the electromagnet 76 is supplied through conductors 79 connecting with suitable switch means (not shown). The lower portion of the sleeve 66 has formed thereon V-shaped notches 66*a* on opposite sides thereof to permit insertion of the elongated spring member 71.

As will be seen in FIG. 2, when the electromagnet 76 is energized, it draws the pin member 65 which is formed of a magnetically attractable material, such as steel, toward the surface 76*a* of the magnet. The lower end of pin member 65 is prevented from touching the upper surface 76*a* of the magnet because the lower surface 78*a* of the conical brake member 78 abuts against the upper surface 66*b* of the sleeve 66. In the position shown in FIG. 2, the electromagnet is energized and the pin member and its associated brake member 78 are retracted from engagement with the bushing 61 positioned in the lower portion of the rotor 31. When it is desired to stop or decelerate the rotation of the rotor, the support air stream is activated and the driving air stream is inactivated. When the rotor decelerates to some predetermined speed above the rotor critical speed, the electromagnet 76 is de-energized. Spring member 71 then forces the pin 65 in the upward direction until the conically shaped brake member 78 engages the lower inner edge 61*a* of the bushing 61 as illustrated in FIG. 3. This exerts a slight force in the upward direction on the spinning rotor which, in turn, produces a drag or frictional load sufficient to cause the rotor to decelerate and come to a stop. As the rotor reduces its speed due to the frictional drag of the conical brake member 78, the brake member also stabilizes the rotor as it passes through critical rotational speeds which might cause it to precess or vibrate to an extent likely to cause it to touch the sides of the seat or to cause the centrifuge materials to be remixed.

The actuating force of spring 71 is kept exceedingly small, as is the amount of friction between the bushing 62 and the brake 78. Thus, the rotor is still largely air supported; however, there is now a much increased lateral restraining force which removes the aforementioned tendency of the rotor to precess or to vibrate. In addition, the small frictional component is sufficient to overcome the effect of "windmilling" and causes the rotor to coast to a smooth, complete stop. When the rotor has stopped completely, the support air stream is then inactivated and the rotor 31 is permitted to come to rest on the stator pad 19. It should be noted that, when the supporting air streams are deactivated, the force of the brake and stabilizing means has very little effect on the support of the rotor which immediately moves downward onto its seat 17. In effect, what has been created is a very lightly loaded mechanical bearing, which may be activated at some speed above the critical speed, during which it has proven impossible to stabilize this type of system by other methods.

As can be seen in FIGS. 2 and 3, the pin 65 may travel upwardly until the spring 71 engages the upper end of the notch 66*a* formed in the lower end of the guide bushing 66. Normally the travel of the pin is very small because the rotor does not move too far upward as it is supported on the air cushion in space 43. The pin and its brake only move sufficiently to engage the bushing 61 in the freely floating rotor 31. Because the rotor does float freely on the air cushion, it is necessary to provide sufficient "travel" for the brake means. Also, by making the brake and stabilizing member 78 conical in shape it is possible to engage the lower edge 61*a* of the friction bushing 61 even though the rotor may be spinning on an axis that may not quite coincide with that of the pin 65. Thus a reasonable room for error is built into the system.

Other means can be employed for supplying an upward biasing force for the brake and stabilizer means. For example, the electromagnet 76 could be employed to repel a pin member 65 made of suitably magnetized material. Or a low pressure air jet could be designed to apply a small upward thrust to the pin member 66 when the driving air is inactivated or when the rotor speed reduces to some predetermined speed above the rotor critical speed.

Figure 7:
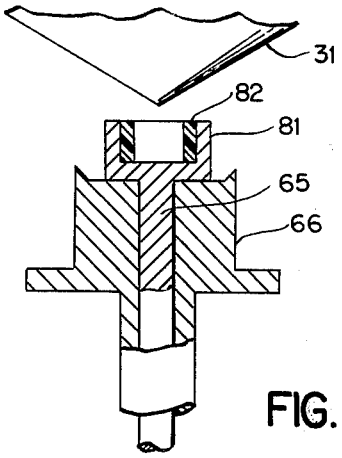
FIG. 7 is a fragmentary elevation view of another embodiment of the brake and stabilizing means.

As will be seen in FIG. 7, there is disclosed a second embodiment of the braking and stabilizing means, in which the rotor is conically shaped at its lowest portion thereof and the pin 65 is provided with a cylindrical bracket 81 in which is mounted a cylindrical bushing 82 formed of TEFLON or the like. When the electromagnet (not shown in this drawing) is de-energized, pin 65 moves upwardly and the bushing 82 contacts the lower slanting surface of the under sidewall of the rotor 31 thereby stabilizing the rotor as it passes through critical precession speeds.

While in accordance with the patent statutes there has been described what at present is considered to be the preferred embodiments of the invention, it will be understood by those skilled in the art that various changes and modifications may be made therein without departing from the invention, and it is, therefore, the aim of the appended claims to cover all such changes and modifications as fall within the true spirit and scope of the invention.

What is claimed is:

1. In an air driven centrifuge including a rotor chamber housing a rotor seat and a rotor having a plurality of turbine flutes formed in an under side thereof, said rotor seat including driving air jet means for impinging pressurized air streams against said turbine flutes for supporting and spinning said rotor on an air cushion above said rotor seat within said chamber, the improvement comprising:

support air jet means for directing pressurized air streams against an underside of said rotor for supporting said rotor in a non-driving position above said rotor seat when said driving air jet means is inactivated; and brake and stabilizing means for decelerating said spinning rotor including:

a friction bearing means mounted on a bottom portion of said rotor, and friction stabilizer means movable into engagement with said bearing means and cooperating with said bearing means to produce a frictional load opposing rotation of said rotor thereby causing said rotor to decelerate and stabilizing said rotor as it reduces from high rotational speed to a stop.

2. The centrifuge defined in claim 1 in which said support air jet means comprises a plurality of jet outlets positioned in said rotor seat and adapted to direct pressurized air streams against a lower portion of said rotor which is free of turbine flutes.

3. The centrifuge defined in claim 2 in which each of said jet nozzles is so constructed and arranged as to direct a pressurized air stream toward said lower portion of said rotor, said air stream flowing against said lower portion of said rotor in a direction substantially parallel to the axis of rotation of the rotor but directed at a small angle opposed to the direction of rotation of said rotor.

4. The centrifuge defined in claim 3 in which said small angle is less than 5° from a plane through the axis of the rotor.

5. The centrifuge defined in claim 1 in which said friction bearing means comprises a bushing mounted in an opening formed in the bottom of said rotor and said stabilizer means includes a frusto-conical shaped brake member adapted for movement upwardly into contact with the lower inner edge of said bushing to produce a frictional load against said bushing.

6. The centrifuge defined in claim 1 in which said bushing is a Teflon cylinder disposed in said hole in the bottom of said rotor, and said frusto-conical shaped brake member is spring loaded in the upward direction.

7. An air driven centrifuge comprising:

a rotor chamber;

a rotor having a lower surface slanting upward in the outward direction and having a plurality of turbine flutes arranged on the lower surface thereof;

a rotor seat disposed in the bottom of said chamber and shaped to support the lower surface of said rotor thereon when said rotor is in a state of rest;

air jet means in said rotor seat for impinging pressurized air streams against said rotor turbine flute for supporting and spinning said rotor on an air cushion above said rotor seat within said chamber;

a friction bearing means mounted on the bottom portion of said rotor; and a friction stabilizer means movable in the upward direction into engagement with said bearing means and cooperating with said bearing means to produce a frictional load against said bearing member thereby causing said rotor to decelerate and stabilizing said rotor as it reduces from high rotational speed to a stop.

8. The centrifuge defined in claim 7 in which said air jet means comprises a plurality of driving air jet nozzles directing air streams at an angle against said turbine flutes for driving and supporting said rotor on an air cushion above said rotor seat and a plurality of support air jets for directing air streams against an under side portion of said rotor which is free of turbine flutes to support said rotor without supplying a driving force.

9. The centrifuge defined in claim 8 including means for discontinuing flow of air through said driving jet nozzles while directing flow of air through said support jet nozzles.

10. The centrifuge defined in claim 7 in which said bearing means comprises a cylindrical bushing mounted in an opening formed in the bottom of said rotor and said stabilizer means includes a frusto-conical shaped brake member adapted for movement upwardly into contact with the lower inner edge of said bushing to produce a frictional load against said bushing opposed to rotation of said rotor.

11. The centrifuge defined in claim 7 in which said bushing is a cylinder of Teflon material disposed in a hole in the bottom of said rotor, and said frusto-conical shaped brake member is spring loaded in the upward direction.

12. The centrifuge defined in claim 10 in which said stabilizer means comprises a pin member supported for axial movement through an opening in said rotor seat, said pin member supporting a frusto-conical shaped brake member attached to the top of said pin member and including spring means for biasing said pin member in the upward direction so that said frusto-conical brake member engages the lower inner edge of said bushing to produce an upward force against said bushing which thereby creates a frictional drag opposed to rotation of said rotor.

13. The centrifuge defined in claim 12 in which said friction stabilizer means includes restraining means for restraining movement of said pin member in the upward direction until said rotor has decelerated to a predetermined rotational speed.

14. The centrifuge defined in claim 13 in which said pin member is formed of a magnetic material and said restraining means comprises an electromagnet disposed beneath said pin member and is adapted to attract said pin member against the bias of said spring when said electromagnet is energized.

15. The centrifuge defined in claim 7 in which said lower surface of said rotor is conical in shape and said friction stabilizer means comprises a cylindrical bushing member movable in the upward direction into engagement with said conical lower surface of said rotor to provide a frictional drag opposing rotation of said rotor.

16. An air driven centrifuge comprising:

a rotor chamber;

a rotor having a lower surface slanting upward in the outer direction and having a plurality of turbine flutes arranged on said lower surface thereof;

a rotor seat disposed in the bottom of said chamber and shaped to support the lower surface of said rotor thereon when said rotor is in a state of rest, said rotor seat having an axial opening through the bottom thereof;

air jet means in said rotor seat for impinging pressurized air streams against said turbine flutes for spinning and supporting said rotor on an air cushion above said rotor seat within said chamber;

a friction bearing means mounted on the bottom portion of said rotor;

a guide bushing positioned in the opening through the bottom of said rotor seat;

a friction stabilizer means in the form of a frusto-conical brake member supported on a pin member mounted within said guide bushing and movable into engagement with said bearing means and cooperating with said bearing means to produce a frictional load against said bearing member thereby causing said rotor to decelerate, said conical brake extending partially into said bushing and stabilizing said rotor against precession as it reduces from high rotational speed to a stop.

17. The centrifuge defined in claim 16 in which said air jet means includes a plurality of driving air jet nozzles directing air streams at an angle against said turbine flutes for driving and supporting said rotor on an air cushion above said rotor seat and a plurality of support air jets for directing air streams against an under side of said rotor which is free of turbine flutes to provide support to said rotor without supplying a substantial driving force.

18. The centrifuge defined in claim 16 in which said pin member is biased in the upward direction toward said rotor and said friction stabilizer means includes means for overcoming said upward bias of said pin member.

19. The centrifuge defined in claim 16 in which said pin member is biased in the direction toward said rotor by a spring member having a longitudinal spring arm providing a small force in the upward direction against said pin.

20. The centrifuge defined in claim 19 in which said brake and stabilizer means includes a restraining means for overcoming the bias of said longitudinal spring arm in the form of an electromagnet disposed beneath said pin member and said pin member is formed of a magnetic material attracted by said electromagnet when energized.

21. The centrifuge defined in claim 20 in which said guide bushing extends into contact with said electromagnet and includes V-shaped notches in the bottom portion thereof through which said longitudinal arm of said spring member extends to engage the pin member disposed within said guide bushing.

* * * * *